United States Patent [19]

Sullaway et al.

[11] 4,337,010

[45] Jun. 29, 1982

[54] INFLATABLE GROUT SEAL

[75] Inventors: Bob L. Sullaway; Harold O. Treece, both of Duncan, Okla.

[73] Assignee: Halliburton Company, Duncan, Okla.

[21] Appl. No.: 103,142

[22] Filed: Dec. 13, 1979

[51] Int. Cl.[3] ..... E02B 17/02; E02D 5/52

[52] U.S. Cl. ..... 405/227; 405/225

[58] Field of Search ..... 277/34, 34.3, 34.6, 277/166, 179, 181, 182, 186, 185, 189, 229, 230; 405/225, 227, 228

[56] References Cited

U.S. PATENT DOCUMENTS

| | | | |
|---|---|---|---|
| 3,468,132 | 9/1969 | Harris . | |
| 3,570,259 | 3/1971 | Thaxton . | |
| 3,702,537 | 11/1972 | Landers . | |
| 3,919,850 | 11/1975 | Coone et al. . | |
| 3,967,456 | 7/1976 | Stone . | |
| 4,041,718 | 8/1977 | Stone . | |
| 4,047,391 | 9/1977 | Mayfield et al. . | |
| 4,052,861 | 10/1977 | Malone et al. . | |
| 4,063,427 | 12/1977 | Hoffman . | |
| 4,140,426 | 2/1979 | Knox | 405/225 |
| 4,181,454 | 1/1980 | Knox et al. | 405/227 |
| 4,220,422 | 9/1980 | Sullaway | 405/225 |

*Primary Examiner*—David H. Corbin

*Attorney, Agent, or Firm*—John H. Tregoning; James R. Duzan

[57] ABSTRACT

An inflatable packer for use on an offshore platform to seal the annulus between the jacket leg or pile sleeve and a pile driven therethrough, the inflatable packer comprising a packer housing, a first guide ring, a second guide ring, an annular inflatable packer member having an annular reinforcing member therein and annular band of material about the inner periphery thereof adjacent each end, first back-up shoe means and second back-up shoe means secured to the first and second guide rings respectively.

8 Claims, 3 Drawing Figures

INFLATABLE GROUT SEAL

This invention relates to an inflatable seal for sealing the annulus between an outer hollow member and an inner member contained therein, and more particularly, relates to an inflatable grouting seal to support a column of grout while the grout is setting in the annulus between the jacket leg of an offshore platform and a pile driven therethrough.

Offshore platforms are usually fabricated in a harbor or on a shore location being subsequently transported on barges or towed horizontally in the water to a marine site where they are uprighted and lowered so that the legs of the platforms rest on the ocean floor. The offshore platform legs are hollow structures having pilings driven downwardly therethrough into subterranean formations below the ocean floor to anchor the platform in position. During the installation of an offshore platform, while the pilings are welded to the jacket legs of the platform at the top thereof, in many instances it is desirable to fill the annulus between the jacket leg and piling driven therethrough with grouting material so that a unitary load bearing structure is created.

To facilitate the grouting of the annulus between the jacket leg and piling driven therethrough a grout seal is frequently utilized.

Typically, prior art grout seals have either been mechanical type grout seals or inflatable type grout seals. Mechanical type grout seals are described in U.S. Pat. Nos. 3,570,259 and 3,702,537. Inflatable type grout seals are described in U.S. Pat. Nos. 3,468,132; 3,919,850; 3,967,456; 4,041,718; 4,047,391; 4,052,861; and 4,063,427. The inflatable type grout seals can generally be separated into inflatable bladder types, shown in U.S. Pat. Nos. 3,468,132; 3,967,456; and 4,047,391; partial movable seal element type shown in U.S. Pat. No. 4,041,718; and annular inflatable member types shown in U.S. Pat. Nos. 3,919,850; 4,052,861 and 4,063,427.

The annular inflatable member types of grout seals, shown in U.S. Pat. Nos. 3,919,850; 4,052,861 and 4,063,427, either contain no reinforcement in the annular inflatable member or only contain annular metallic reinforcing sheaths or individual reinforcing members in the annular inflatable member as a reinforcement means thereof.

In contrast to the prior art type of grout seals having annular inflatable members, the grout seal of the present invention comprises a grout seal having an annular inflatable member which is reinforced substantially throughout by an annular member of flexible fabric and annular bands of material at either end thereof about the inner periphery and is supported during the inflation thereof by back-up shoe means.

The advantages of the present invention and the preferred embodiment will be better understood from the following specification taken in conjunction with the accompanying drawings wherein.

Figure 1:
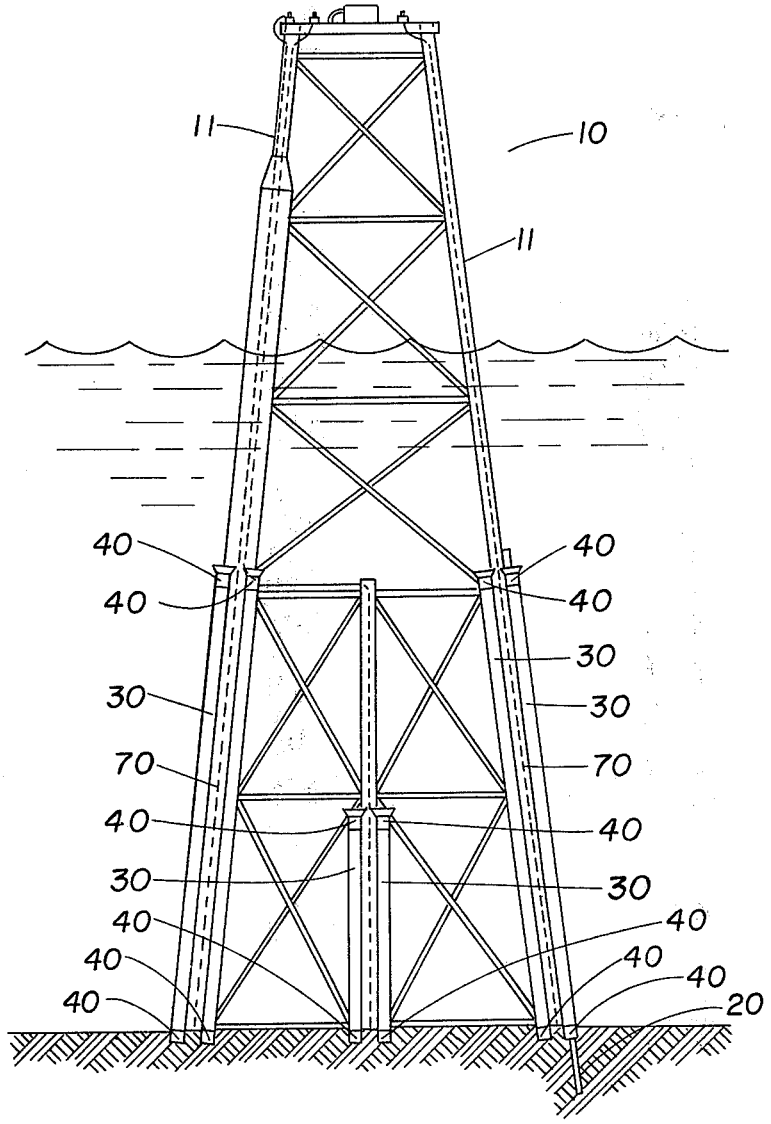
FIG. 1 shows the invention installed in the pile sleeves of an offshore platform.

Referring to FIG. 1, an offshore platform 10 is shown having the inflatable packers 40 installed in the top and bottom of the pile sleeves 30 of the jacket legs 11 and intermediate the jacket legs 11. A pile 20 is shown as being driven to depth through a pile sleeve 30 and being terminated above the upper inflatable packer 40 installed thereon. Although shown installed on the pile sleeves 30, the inflatable packers 40 may be installed also on the jacket legs 11. The inflation lines 70 run to the inflatable packers 40 while the grout lines 80 (see FIGS. 2 and 3) and grout return lines are not shown for purposes of clarity.

Figure 2:
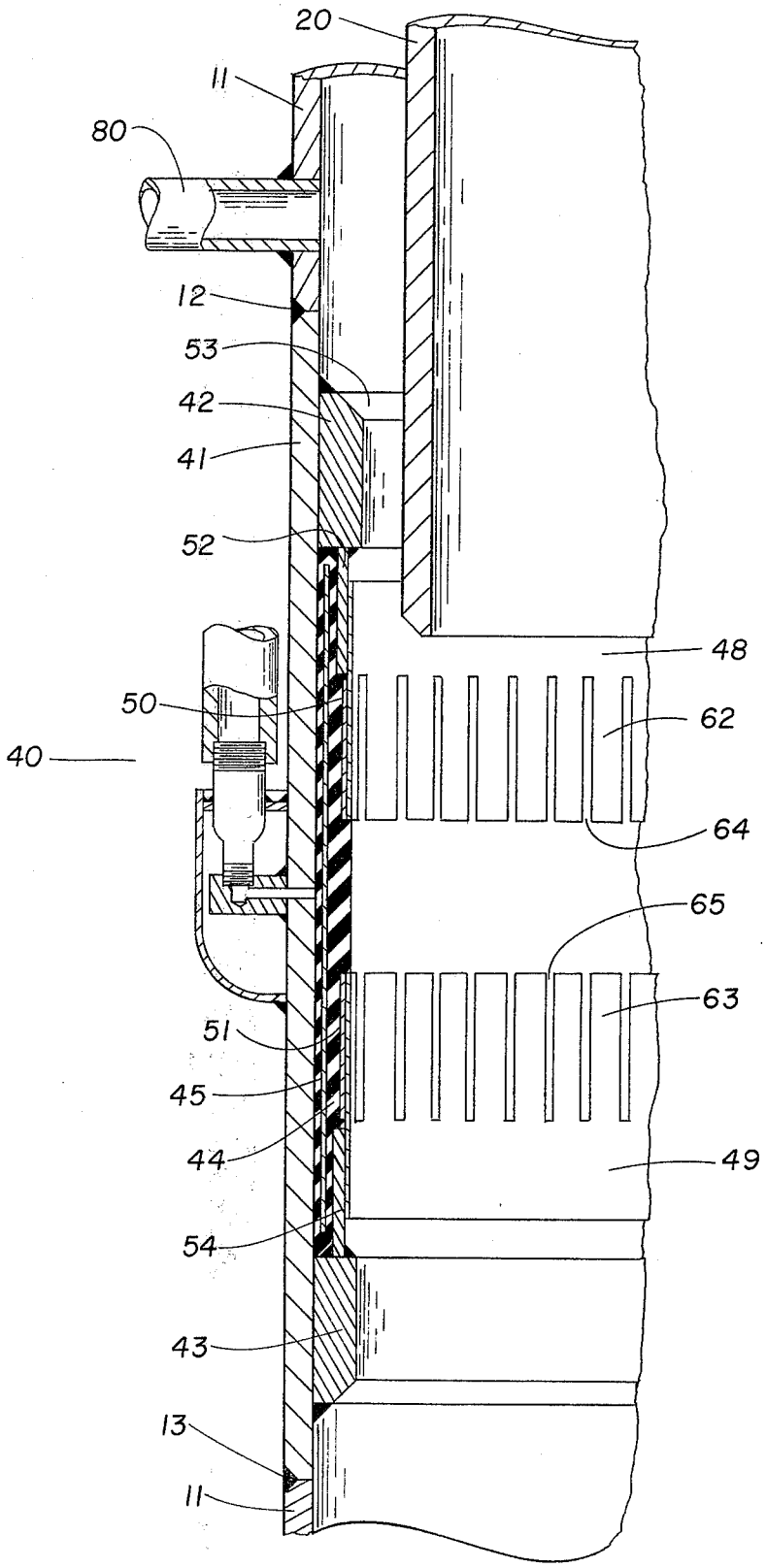
FIG. 2 shows the invention in partial cross-section installed in a jacket leg or pile sleeve in an uninflated position.

Referring to FIG. 2, the present invention is shown in its preferred embodiment. The inflatable packer 40 comprises a packer housing 41, guide rings 42 and 43, an annular elastomeric packer member 44 and packer member back-up shoes 48 and 49. The packer housing 41 comprises a cylindrical member made in any convenient diameter to match the jacket leg 11 or pile sleeve to which it is welded as at 12 and 13.

The guide ring 42 is welded to the packer housing 41 to secure one end of the packer member 44 within the packer housing 41 from any axial movement therein. The guide ring 42 is formed having a reduced thickness portion 52 which mates with the end of annular packer member 44 and is secured thereto. The guide ring 42 further includes annular chamfered surface 53 to assist in guiding the pile 20 through the packer 40 without contacting therewith. The guide ring 42 should be formed having an inner diameter which is sufficiently less than the inner diameter of reduced thickness portion 52 to prevent the pile 20 from contacting the annular packer member 44 when the pile is inserted through the inflatable packer 40.

Similarly, guide ring 43 is welded to the packer housing 41 to secure the other end of the annular packer member 44 within the packer housing 41 from any axial movement therein. The guide ring 43 is formed with a reduced thickness portion 54 which mates with the end of packer member 44 and is secured thereto.

The guide rings 42 and 43 may be fabricated as a single machined element or, alternatively, may be fabricated as weldments.

The annular packer member 44 comprises an annular elastomeric member which may be formed of any suitable elastomeric material, although rubber is preferred. The annular packer member 44 has an annular reinforcing member 45 which extends substantially throughout the entire packer member 44 and terminates adjacent the ends thereof. The reinforcing member 45 can be of any suitable material, although a fabric of nylon is preferred. The annular packer member 44 further comprises an annular band of material 50 located adjacent one end of the packer member 44 on the inner diameter thereof which underlies the fingers 62 of back-up shoe 48 while an annular band of material 51 located adjacent the other end of the packer member 44 on the inner diameter thereof underlies the fingers 63 of back-up shoe 49. The annular bands 50 and 51 of the material serve to protect the packer member 44 from damage by the fingers 62 and 63 of the back-up shoes 48 and 49 respectively when the packer member 44 is being inflated and to prevent the flow of rubber into the slots 64 and 65 when the packer member 44 is being formed. The annular bands 50 and 51 may be formed of any suitable flexible material which has sufficient strength to protect packer member 44, such as steel, brass, etc., although a fabric of nylon is preferred. The packer member 44 is secured to end rings 42 and 43 by being bonded thereto along the reduced thickness portions 52 and 54 respectively. It is necessary for the reduced thickness portions 52 and 54 of end rings 42 and 43 respectively be of sufficient length to provide the necessary bonding area to secure the ends of packer member 44 thereto depending upon the anticipated inflation pressure and axial loading to be utilized and placed upon the inflatable packer 40.

By reinforcing the annular packer member 44 utilizing an annular reinforcing member 45 which extends substantially throughout the entire packer member 44 and terminates adjacent the ends thereof and by utilizing annular bands of material 50 and 51, the construction of the annular packer member 44 is facilitated since the addition of the annular reinforcing member 45 and annular bands of material 50 and 51 during the manufacture of the annular packer member 44 require only simple procedures and do not require the wrapping of reinforcing members of fabric about additional reinforcing members in the annular packer member 44 or does not require that the reinforcing members of fabric be formed in the shape of a fluid-tight bladder. Additionally, by forming the annular packer member 44 having annular reinforcing member 45 therein and annular bands of material 50 and 51 thereon the annular packer member is more resistant to tearing, bursting, damage, etc. than an unreinforced elastomeric packer member. Furthermore, by utilizing and by forming the annular packer member 44 having annular reinforcing member 45 of fabric therein and annular bands of material 50 and 51 thereon, during use the annular packer member 44 does not suffer from the problems, such as lack of strength, tearing, cutting, etc., of an annular packer member which is an elastomeric member reinforced by annular metal sheaths or individual reinforcing members which may be bonded thereto or merely in engagement therewith.

The back-up shoe 48 is an annular metal band having fingers 62 separated by spaces 64 and is located on the inner diameter of the packer member 44 adjacent one end thereof. Similarly, the back-up shoe 49 is an annular metal band having fingers 63 separated by spaces 65 and is located on the inner diameter of the packer member 44 adjacent the other end thereof. The back-up shoes 48 and 49 may be formed of any suitable metal, although steel is preferred. The back-up shoes 48 and 49 initially protect the packer member 44 from being damaged by the pile 20 while the pile is being driven therethrough since the back-up shoes 48 and 49 hold the packer member 44 against the packer housing 41 until the packer member 44 is inflated. The back-up shoes 48 and 49 may be secured to the end rings 42 and 43 by any convenient securing means, such as welding.

Figure 3:
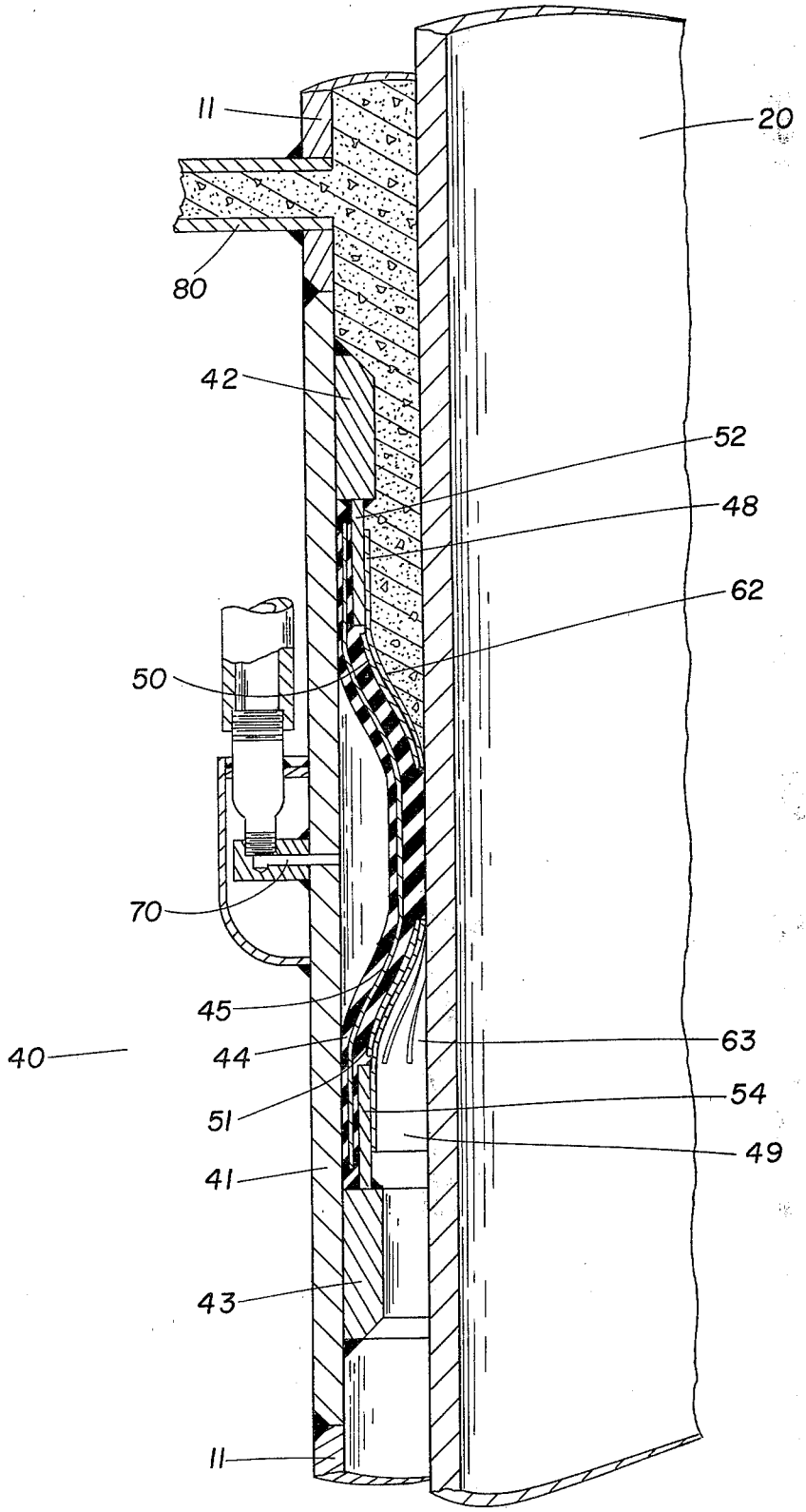
FIG. 3 shows the invention in partial cross-section installed in a jacket leg or pile sleeve in an inflated position with grout filling the annulus between the pile and the jacket leg or pile sleeve.

Referring to FIG. 3, the inflatable packer 40 is shown in its inflated position. The packer member 44 is inflated to firmly grip the pile 20, which has been driven to the desired depth, by pumping any suitable liquid or gas under pressure through the packer inflation port 70. As shown, when the packer member 44 is inflated, the back-up shoes 48 and 49 are deflected inwardly until the fingers 62 and 63 are seated on the pile 20. When the packer member 44 is in its inflated position, the back-up shoes 48 and 49 lend axial support to the packer member 44 and prevent axial extrusion and subsequent damage of the packer member 44 over the reduced thickness portions 52 and 54 of the guide rings 42 and 43 respectively.

The ends of the packer member 44 may be secured against axial movement within the packer housing 41 by the guide rings 42 and 43 since the inflation of the packer member 44 occurs inwardly.

After the packer member 44 has been inflated, grouting material is pumped through grouting line 80 into the annulus between the pile 20 and the platform jacket leg 11 above the inflatable packer 40 with the packer supporting the weight of the grouting in the annulus while preventing the grouting from leaking into the annulus below the inflatable packer 40 or the surrounding environment from leaking into the annulus above the packer 40 and contaminating the grouting material.

It should be understood that when the inflatable packer 40 is inflated with a liquid, such as water, since the inflatable packer has back-up shoes 48 and 49 installed thereof in seated engagement with the pile 20 driven therethrough, any pressure from the weight of the column of grout which is applied to the packer member 44 will cause the packer member 44 to more firmly engage the pile 20 since the back-up shoe 49 supports the packer member 44 to prevent the extrusion thereof over reduced thickness portion 54 of the guide ring 43.

Although the inflatable packer has been described for use in platform jacket leg and pile sleeve grouting operations, the inflatable packer may be used in any situation where a seal is desired between two members such as concentric pipes, a pipe and a wall, etc.

It should be evident from the foregoing description of the present invention that it offers several improvements and advantages over the prior art grout seals.

One advantage of the present invention results from its simplicity of construction thereby lowering manufacturing costs.

Another advantage of the present invention is the simplicity of construction of the packer member. The packer member is reinforced by means of an annular member of fabric which extends substantially throughout the packer member and contains annular bands of material which underlie the back-up shoes to protect the packer member during manufacture and use. The packer member is also secured to the end rings solely by bonding thereto which simplifies the construction of the end rings and packer fabrication process.

Yet another advantage of the present invention results from the use of back-up shoes to protect the packer member during pile driving operations and to support the packer member during the inflation thereof to prevent the extrusion of the packer member over the end rings during axial loading of the packer member.

Having thus described my invention, I claim:

1. An inflatable packer comprising:

annular packer housing means;

first guide ring means secured within said annular packer housing means, said first guide ring means including a first annular portion having one end secured to the interior of said annular packer housing means and a second annular portion secured to the other end of the first annular portion, the second annular portion having an inner diameter larger than the inner diameter of the first annular portion, an outer diameter smaller than the outer diameter of the first annular portion, a substantially uniform cross-sectional thickness, and substantially uniform uninterrupted interior and exterior surfaces thereon;

second guide ring means secured within said annular packer housing means, said second guide ring means including a first annular portion having one end secured to the interior of said annular packer housing means and a second annular portion secured to the other end of the first annular portion, the second annular portion having an inner diameter larger than the inner diameter of the first annular portion, an outer diameter smaller than the outer diameter of the first annular portion, a substantially uniform cross-sectional thickness, and substantially uniform uninterrupted interior and exterior surfaces thereon;

annular inflatable packer member means having a first end portion, intermediate portion, a second end portion and annular reinforcement member means extending substantially throughout said annular inflatable packer member means terminating in the first and second end portions thereof, the first end portion secured from axial movement within said annular packer housing means by being bonded to the uniform uninterrupted exterior surface of the second annular portion of said first guide ring means while the second end portion of said annular inflatable packer member means is secured from axial movement within said annular packer housing means by being bonded to the uniform uninterrupted exterior surface of the second annular portion of said second guide ring means;

first back-up shoe means adjacent the first end portion of said annular inflatable packer member means extending about the interior thereof, said first back-up shoe means being secured to said first guide ring means; and second back-up shoe means adjacent the second end portion of said annular inflatable packer member means extending about the interior thereof, said second back-up shoe means being secured to said second guide ring means.

2. The inflatable packer of claim 1 wherein said annular inflatable packer member means further comprises an annular band of material disposed about the inner periphery of the first end portion of the annular inflatable packer member means having a portion underlying said first back-up shoe means and an annular band of material disposed about the inner periphery of the second end portion of the annular inflatable packer member means having a portion underlying said second back-up shoe means.

3. An inflatable packer for use in sealing the annulus between a jacket leg or pile sleeve of an offshore platform and a pile driven therethrough, said inflatable packer comprising:

annular packer housing means;

first guide ring means secured within said annular packer housing means, said first guide ring means including a first annular portion having one end secured to the interior of said annular packer housing means and a second annular portion secured to the other end of the first annular portion, the second annular portion having an inner diameter larger than the inner diameter of the first annular portion, an outer diameter smaller than the outer diameter of the first annular portion, a substantially uniform cross-sectional thickness, and substantially uniform uninterrupted interior and exterior surfaces thereon;

second guide ring means secured within said packer housing means, said second guide ring means including a first annular portion having one end secured to the interior of said annular packer housing means and a second annular portion secured to the other end of the first annular portion, the second annular portion having an inner diameter larger than the inner diameter of the first annular portion, an outer diameter smaller than the outer diameter of the first annular portion, a substantially uniform cross-sectional thickness, and substantially uniform uninterrupted interior and exterior surfaces thereon;

annular inflatable packer member means having a first end portion, intermediate portion, a second end portion and annular reinforcment member means extending substantially throughout said annular inflatable packer member means terminating in the first and second end portions thereof, the first end portion secured from axial movement within said annular packer housing means by being bonded to the uniform uninterrupted exterior surface of the second annular portion of said first guide ring means while the second end portion of said annular inflatable packer member means is secured from axial movement within said annular packer housing means by being bonded to the uniform uninterrupted exterior surface of the second annular portion of said second guide ring means;

first back-up shoe means adjacent the first end portion of said annular inflatable packer member means extending about the interior thereof, said first back-up shoe means being secured to said first guide ring means; and second back-up shoe means adjacent the second end portion of said annular inflatable packer member means extending about the interior thereof, said second back-up shoe means being secured to said second guide ring means;

whereby said first back-up shoe means and said second back-up shoe means are deformed to seat against said pile to support said annular inflatable packer member means when said inflatable packer is inflated to seal said annulus, thereby preventing the extrusion of said annular inflatable packer member means over the second annular portion of the first guide ring means and the second annular portion of said second guide ring means.

4. The inflatable packer of claim 3 wherein said annular inflatable packer member means further comprises an annular band of material disposed about the inner periphery of the first end portion of the annular inflatable packer member means having a portion underlying said first back-up shoe means and an annular band of material disposed about the inner periphery of the second end portion of the annular inflatable packer member means having a portion underlying said second back-up shoe means.

5. An inflatable packer comprising:

annular packer housing means;

first guide ring means secured within said annular packer housing means, said first guide ring means including a first annular portion having one end secured to the interior of said annular packer housing means and a second annular portion secured to the other end of the first annular portion, the second annular portion having an inner diameter larger than the inner diameter of the first annular portion, an outer diameter smaller than the outer diameter of the first annular portion, a substantially uniform cross-sectional thickness, and substantially uniform uninterrupted interior and exterior surfaces thereon;

second guide ring means secured within said annular packer housing means, said second guide ring means including a first annular portion having one end secured to the interior of said annular packer housing means and a second annular portion secured to the other end of the first annular portion, the second annular portion having an inner diameter larger than the inner diameter of the first annular portion, an outer diameter smaller than the outer diameter of the first annular portion, a substantially uniform cross-sectional thickness, and substantially uniform uninterrupted interior and exterior surfaces thereon;

annular inflatable packer member means having a first end portion, intermediate portion, a second end portion, annular reinforcement member means extending substantially throughout said annular inflatable packer member means terminating in the first and second end portions thereof, an annular band of material disposed about the inner periphery of the first end portion thereof, and an annular band of material disposed about the inner periphery of the second end portion thereof, the first end portion secured from axial movement within said annular packer housing means by being bonded to the uniform uninterrupted exterior surface of the second annular portion of said first guide ring means while the second end portion of said annular packer member means is secured from axial movement within said annular packer housing means by being bonded to the uniform uninterrupted exterior surface of said second guide ring means;

first back-up shoe means adjacent the first end portion of said annular inflatable packer member means extending about the interior thereof overlying a portion of the annular band of material on the first end portion of said annular inflatable packer member means, said first back-up shoe means being secured to said first guide ring means; and second back-up shoe means adjacent the second end portion of said annular inflatable packer member means extending about the interior thereof overlying a portion of the annular band of material on the second end portion of said annular inflatable packer member means, said second back-up shoe means being secured to said second guide ring means.

6. An inflatable packer for use in sealing the annulus between a jacket leg or pile sleeve of an offshore platform and a pile driven therethrough, said inflatable packer comprising:

annular packer housing means;

first guide ring means secured within said annular packer housing means, said first guide ring means including a first annular portion having one end secured to the interior of said annular packer housing means and a second annular portion secured to the other end of the first annular portion, the second annular portion having an inner diameter larger than the inner diameter of the first annular portion, an outer diameter smaller than the outer diameter of the first annular portion, a substantially uniform cross-sectional thickness, and substantially uniform uninterrupted interior and exterior surfaces thereon;

second guide ring means secured within said annular packer housing means, said second guide ring means including a first annular portion having one end secured to the interior of said annular packer housing means and a second annular portion secured to the other end of the first annular portion, the second annular portion having an inner diameter larger than the inner diameter of the first annular portion, an outer diameter smaller than the outer diameter of the first annular portion, a substantially uniform cross-sectional thickness, and substantially uniform uninterrupted interior and exterior surfaces thereon;

annular inflatable packer member means having a first end portion, intermediate portion, a second end portion, annular reinforcement member means extending substantially throughout said annular inflatable packer member means terminating in the first and second end portions thereof, an annular band of material disposed about the inner periphery of the first end portion thereof, and an annular band of material disposed about the inner periphery of the second end portion thereof, the first end portion secured from axial movement within said annular packer housing means by being bonded to the uniform uninterrupted exterior surface of the second annular portion of said first guide ring means while the second end portion of said annular packer member means is secured from axial movement within said annular packer housing means by being bonded to the uniform uninterrupted exterior surface of said second guide ring means;

first back-up shoe means adjacent the first end portion of said annular inflatable packer member means extending about the interior thereof overlying a portion of the annular band of material on the first end portion of said annular inflatable packer member means said first back-up shoe means being secured to said first guide ring means; and second back-up shoe means adjacent the second end portion of said annular inflatable packer member means extending about the interior thereof overlying a portion of the annular band of material on the second end portion of said annular inflatable packer member means, said second back-up shoe means being secured to said second guide ring means;

whereby said first back-up shoe means and said second back-up shoe means are deformed to seat against said pile to support said annular inflatable packer member means when said inflatable packer is inflated to seal said annulus, thereby preventing the extrusion of said annular inflatable packer member means over the second annular portion of the first guide ring means and the second annular portion of said second guide ring means.

7. An inflatable packer comprising:

an annular packer housing means;

first guide ring means secured within said annular packer housing means, said first guide ring means including a first annular portion having one end secured to the interior of said annular packer housing means and a second annular portion secured to the other end of the first annular portion, the second annular portion having an inner diameter larger than the inner diameter of the first annular portion, an outer diameter smaller than the outer diameter of the first annular portion, a substantially uniform cross-sectional thickness, and substantially uniform uninterrupted interior and exterior surfaces thereon;

second guide ring means secured within said annular packer housing means, said second guide ring means including a first annular portion having one end secured to the interior of said annular packer housing means and a second annular portion secured to the other end of the first annular portion, the second annular portion having an inner diameter larger than the inner diameter of the first annular portion, an outer diameter smaller than the outer diameter of the first annular portion, a substantially uniform cross-sectional thickness, and substantially uniform uninterrupted interior and exterior surfaces thereon;

annular inflatable packer member means having a first end portion, intermediate portion, a second end portion and annular reinforcement member means extending substantially throughout said annular inflatable packer member means terminating in the first and second end portions thereof, the first end portion secured from axial movement within said annular packer housing means by being bonded to the uniform uninterrupted exterior surface of the second annular portion of said first guide ring means while the second end portion of said annular inflatable packer member means is secured from axial movement within said annular packer housing means by being bonded to the uniform uninterrupted exterior surface of the second annular portion of said second guide ring means;

a first back-up shoe secured to said first guide ring adjacent the first end portion of said inflatable packer member means being located on the interior thereof, said first back-up shoe comprising:

an annular band having a plurality of fingers extending therefrom, each finger of the plurality of fingers being separated from an adjacent finger thereby forming a space between each adjacent finger of the plurality of fingers whereby said first back-up shoe overlays the first end portion of said inflatable packer member means thereby preventing the first end portion of said inflatable packer member from extending into said annulus before the inflation of said inflatable packer member means to prevent said pile from damaging said inflatable packer member means during the insertion of said pile therethrough; and a second back-up shoe secured to said second guide ring adjacent the second end portion of said inflatable packer member means being located on the interior thereof, said second back-up shoe comprising:

an annular band having a plurality of fingers extending therefrom, each finger of the plurality of fingers being separated from an adjacent finger thereby forming a space between each adjacent finger of the plurality of fingers whereby said second back-up shoe overlays the second said portion of said inflatable packer member means thereby preventing the second end portion of said inflatable packer member from extending into said annulus before the inflation of said inflatable packer member means to prevent said pile from damaging said inflatable packer member means during the insertion of said pile therethrough.

8. An inflatable packer for use in the sealing of an annulus formed by a jacket leg and/or pile sleeve of a marine platform having a pile inserted therethrough prior to the grouting of said annulus, or the like, said inflatable packer comprising:

an annular packer housing means secured to said jacket leg, said pile sleeve, or the like;

first guide ring means secured within said annular packer housing means, said first guide ring means including a first annular portion having one end secured to the interior of said annular packer housing means and a second annular portion secured to the other end of the first annular portion, the second annular portion having an inner diameter larger than the inner diameter of the first annular portion, an outer diameter smaller than the outer diameter of the first annular portion, a substantially uniform cross-sectional thickness, and substantially uniform uninterrupted interior and exterior surfaces thereon;

second guide ring means secured within said annular packer housing means, said second guide ring means including a first annular portion having one end secured to the interior of said annular packer housing means and a second annular portion secured to the other end of the first annular portion, the second annular portion having an inner diameter larger than the inner diameter of the first annular portion, an outer diameter smaller than the outer diameter of the first annular portion, a substantially uniform cross-sectional thickness, and substantially uniform uninterrupted interior and exterior surfaces thereon;

annular inflatable packer member means having a first end portion, intermediate portion, a second end portion and annular reinforcement member means extending substantially throughout said annular inflatable packer member means terminating in the first and second end portions thereof, the first end portion secured from axial movement within said annular packer housing means by being bonded to the uniform uninterrupted exterior surface of the second annular portion of said first guide ring means while the second end portion of said annular inflatable packer member means is secured from axial movement within said annular packer housing means by being bonded to the uniform uninterrupted exterior surface of the second annular portion of said second guide ring means;

a first back-up shoe secured to said first guide ring adjacent the first end portion of said inflatable packer member means being located on the interior thereof, said first back-up shoe comprising:

an annular band having a plurality of fingers extending therefrom, each finger of the plurality of fingers being separated from an adjacent finger thereby forming a space between each adjacent finger of the plurality of fingers whereby said first back-up shoe overlays the first end portion of said inflatable packer member means thereby preventing the first end portion of said inflatable packer member means from extending into said annulus before the inflation of said inflatable packer to prevent said pile from damaging said inflatable packer member means during the insertion of said pile therethrough; and a second back-up shoe secured to said second guide ring adjacent the second end portion of said inflatable packer member means being located on the interior thereof, said second back-up shoe comprising:

an annular band having a plurality of fingers extending therefrom, each finger of the plurality of fingers being separated from an adjacent finger thereby forming a space between each adjacent finger of the plurality of fingers whereby said second back-up shoe overlays the second said portion of said inflatable packer member means thereby preventing the second end portion of said inflatable packer member means from extending into said annulus before the inflation of said inflatable packer member means to prevent said pile from damaging said inflatable packer member means during the insertion of said pile therethrough whereby when said inflatable packer member means is inflated to seal said annulus, said inflatable packer member means is inflated inwardly so that the intermediate portion thereof firmly engages said pile to seal said annulus while said first back-up shoe and said second back-up shoe have the plurality of fingers thereof deflected inwardly until seated on said pile thereby lending axial support to said inflatable packer member means and preventing axial extrusion of the first end portion and second end portion of said inflatable packer member means over said first end ring and said second end ring respectively during the inflation of said inflatable packer member and the grouting of said annulus.

* * * * *